United States Patent [19]

Nakamura

[11] Patent Number: 4,616,208

[45] Date of Patent: Oct. 7, 1986

[54] SYSTEM FOR INDICATING OPERATION TIME OF MOTOR VEHICLES AND THE LIKE

[76] Inventor: Koichi Nakamura, 1-9-2, Shinyashiki, Kochi-Shi, Kochi-Ken, Japan

[21] Appl. No.: 467,265

[22] Filed: Feb. 17, 1983

[30] Foreign Application Priority Data

Mar. 26, 1982 [JP] Japan ..... 57-47250

[51] Int. Cl.[4] ..... G08B 1/00; G08B 23/00

[52] U.S. Cl. ..... 340/309.15; 340/575; 340/576

[58] Field of Search ..... 340/309.15, 309.4, 575, 340/576; 180/272; 128/719

[56] References Cited

U.S. PATENT DOCUMENTS

| | | | |
|---|---|---|---|
| 3,026,503 | 3/1962 | Scheer | 340/575 |
| 3,823,382 | 7/1974 | Gaddy | 340/576 |
| 4,222,028 | 9/1980 | Danchilla | 340/309.15 |
| 4,234,051 | 11/1980 | Morris, Jr. | 340/575 |
| 4,392,122 | 7/1983 | Hocken | 340/309.15 |

*Primary Examiner*—John W. Caldwell, Sr.
*Assistant Examiner*—Tyrone Queen
*Attorney, Agent, or Firm*—Martin Smolowitz

[57] ABSTRACT

The driver of a vehicle is informed that he has driven continuously for a present limit driving time and thus should rest for a preset rest period by a system comprising: a first timer for setting the limit driving time and starting to operate upon detecting that the vehicle driving has started; a second timer for setting the rest period and starting to operate upon detecting stopping of driving; warning means for emitting a warning upon detecting that the set limit driving time has been counted after start of the first timer operation; means for rendering the warning means inoperative upon detecting that the set rest period has been counted after start of the second timer operation; and means for causing the operation of the first timer to continue when the vehicle driving is restarted before completion of counting of the set rest period after start of the second timer operation.

20 Claims, 8 Drawing Figures

SYSTEM FOR INDICATING OPERATION TIME OF MOTOR VEHICLES AND THE LIKE

BACKGROUND OF THE INVENTION

This invention relates to a system for informing the operator of a motor vehicle or the like of its operation time, and relates more particularly to such an operation time informing system for preventing operational accidents caused by fatigue of the operator due to excessive continuous operation time.

It is known that, in general, when an operator of a vehicle, such as a motor vehicle driver, has driven his vehicle continuously over a long period of time, the resulting fatigue gives rise to a drop in his attentive power and a dulling of his reflexes or to sleepiness, all of which increase the danger of an accident. In order to prevent such an accident, it is necessary for a driver to rest periodically.

However, since there has heretofore been no means of measuring driving time and notifying the driver of that time in a conventional motor vehicle, the only recourse for the driver has been to exercise care and remind himself to rest periodically.

SUMMARY OF THE INVENTION

It is an object of this invention to provide an operation time informing system (hereinafter referred to simply as system) of a motor vehicle or the like, which system operates when the vehicle has been continuously operated for a preset limit time to inform the operator of that fact and suggest to him to rest and, in the case where he has taken a short rest which is less than the ncessary rest period, to count this time as continuous operation time without considering it as rest time, thereby to prevent operational accidents arising from fatigue of the operator.

According to this invention, briefly summarized, there is provided a system for informing the operator of a vehicle or the like of operation time of the vehicle, which system comprises: a first timer for setting a limit operation time period which starts to operate and to count time upon detecting starting of the vehicle driving operation; a second timer for setting a rest time period which starts to operate and to count time upon detecting stopping of the vehicle driving operation; warning means for generating and emitting a warning upon detection that counting of the limit operation time period set by the first timer has been completed after start of operation of the first timer; means for causing the warning means to become inoperative upon detecting that counting of the rest time period set by the second timer has been completed after start of operation of the second timer; and means for causing the operation of the first timer to continue when the vehicle operation is restarted before completion of counting of the rest time period set by the second timer after start of operation of the second timer.

The nature, utility, and further features of this invention will be more clearly apparent from the following detailed description with respect to a preferred embodiment of the invention when read in conjunction with the accompanying drawings briefly described below.

DETAILED DESCRIPTION OF THE INVENTION

The example of the system illustrated in the FIGS. 1–8 drawings has first and second electric relays $R_1$ and $R_2$, a first electric timer $T_o$ for setting operation or driving time, a second electric timer $T_r$ for setting rest period, and a pilot lamp PL used as a warning device, which are mutually connected in parallel and, at the same time, are connected through a fuse F in series with a battery B mounted on a motor vehicle.

The first relay $R_1$ is connected in series with an engine switch SW for closing and opening the engine ignition system of the vehicle. When this engine switch SW is closed, the relay $R_1$ is connected in series with the battery B, and its relay coil (not shown) is energized. The relay $R_1$ has a normally open contact (a-contact) $S_{R1\text{-}a}$ and a normally closed contact (b-contact) $S_{R1\text{-}b}$. The second relay $R_2$ has normally open contacts (a-contacts) $S_{R2\text{-}a1}$ and $S_{R2\text{-}a2}$. The timers $T_o$ and $T_r$ respectively have a normally open time limit contact (a-contact) $S_{To\text{-}a}$ and a normally closed time limit contact (b-contact) $S_{Tr\text{-}b}$.

To the timer $T_o$ and relay $R_2$ are respectively connected in series the a-contact $S_{R1\text{-}a}$ which closes when current is passed through the relay $R_1$ and the a-contact $S_{R2\text{-}a1}$ which is connected in parallel with the a-contact $S_{R1\text{-}a}$ and closes when current is passed through the relay $R_2$. Furthermore, to these a-contacts $S_{R1\text{-}a}$ and $S_{R2\text{-}a1}$ is connected in series the time limit b-contact $S_{Tr\text{-}b}$ which opens during a certain time period when a set time period of the timer $T_r$ has elapsed after start of its operation.

To the timer $T_r$ are respectively connected in series the a-contact $S_{R2\text{-}a2}$ which is closed by passage of current through the relay $R_2$ and the b-contact $S_{R1\text{-}b}$ which is opened by passage of current through the relay $R_1$. Further, the time limit a-contact $S_{To\text{-}a}$ is connected in series with the pilot lamp PL, the contact $S_{To\text{-}a}$ closing during a certain time period when a set time period of the timer $T_o$ has elapsed after start of its operation. The timer $T_o$ is so set that its set operation time period is ordinarily of the order of 2 to 3 hours, while the timer $T_r$ is so set that its set rest time period is ordinarily of the order of 5 to 10 minutes.

The operation of the system of the above described organization according to this invention is as follows.

Figure 1:
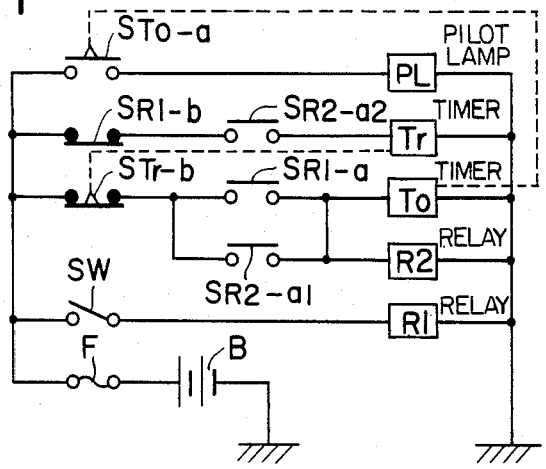
FIGS. 1 through 8 are circuit diagrams showing the essential parts of one example of the system according to this invention and respectively indicating sequential steps in the operation thereof.

FIG. 1 indicates the state of the system wherein the engine switch SW is open prior to starting of the vehicle engine. In this case, the two relays $R_1$ and $R_2$ and the two timers $T_o$ and $T_r$ are all inoperative. Consequently, the a-contacts $S_{R1\text{-}a}$, $S_{R2\text{-}a1}$, $S_{R2\text{-}a2}$, and $S_{To\text{-}a}$ are in open or "OFF" state, while the b-contacts $S_{R1\text{-}b}$ and $S_{Tr\text{-}b}$ are in closed or "ON" state.

Figure 2:
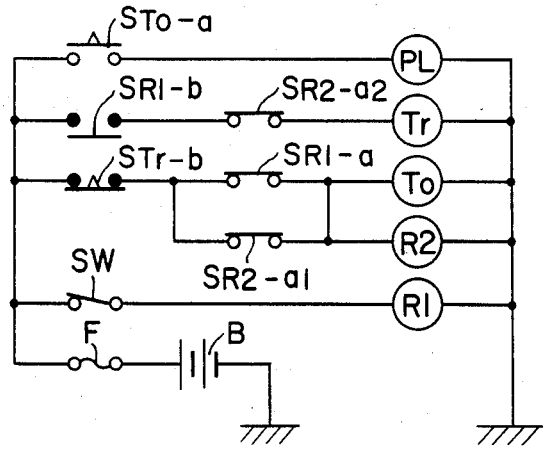

When, from the above described state, the engine switch SW is closed, first current is passed through The relay $R_1$ and the a-contact $S_{R1\text{-}a}$ is closed, while the b-contact $S_{R1\text{-}b}$ is opened as indicated in FIG. 2. When the a-contact $S_{R1\text{-}a}$ is thus closed, current is passed through the relay $R_2$ connected in series thereto, whereby the a-contacts $S_{R2\text{-}a1}$ and $S_{R2\text{-}a2}$ are closed, and, at the same time, the timer $T_o$ starts its operation to count the operation time period.

Figure 3:
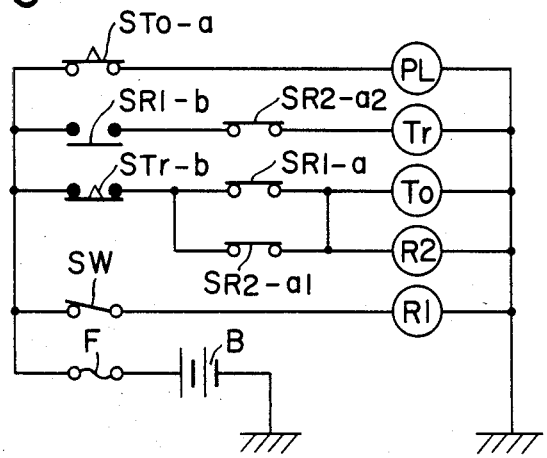

When, with the system in this state, the driving of the vehicle is continued up to the time limit set by the timer $T_o$, the time limit a-contact $S_{To\text{-}a}$ is closed by the operation of the timer $T_o$ as indicated in FIG. 3, and the pilot lamp PL is lit, thereby suggesting to the driver that he should rest. Accordingly, the driver can rest in conformance with this warning.

Figure 4:
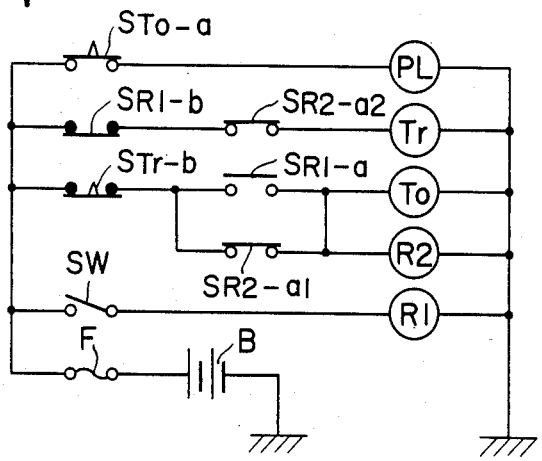

When, with the system in this state, the driver turns "OFF" the engine switch SW in order to rest, current to the relay $R_1$ is cut off as indicated in FIG. 4, and the a-contact $S_{R1-a}$ is opened, while the b-contact $S_{R1-b}$ is closed. On the other hand, the supply of current through the relay $R_2$ is continued by way of the b-contact $S_{Tr-b}$ and the a-contact $S_{R2-a1}$, whereby the a-contact $S_{R2-a2}$ is maintained in its closed state. Accordingly, simultaneously with opening of the engine switch SW, current is passed by way of the b-contact $S_{R1-b}$ and the a-contact $S_{R2-a2}$ through the timer $T_r$ for setting the rest period, which thereupon begins counting the rest time period. Since the supplying of current through the timer $T_o$ is being continued during this operation, the pilot lamp PL is maintained in its lit state.

Figure 5:
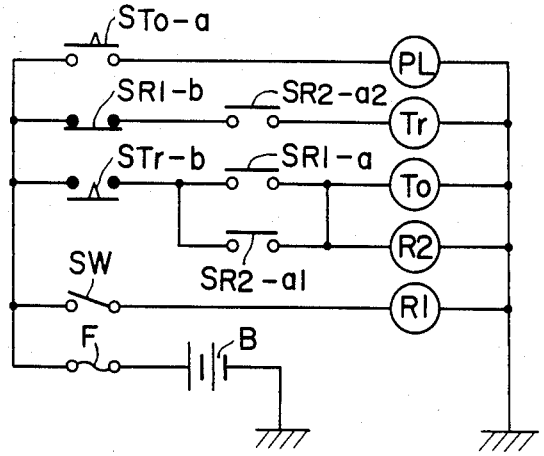

When, with the system in this state, the driver takes a rest up to the time limit set by the timer $T_r$, the time limit b-contact $S_{Tr-b}$ is opened by the operation of the timer $T_r$ as indicated in FIG. 5. The supply of current to the timer $T_o$ is thereupon cut off, and the time limit a-contact $S_{To-a}$ is opened, whereby the pilot lamp PL is extinguished. The timer $T_o$ returns to its initial state prior to the start of counting. Simultaneously, the supply of current to the relay $R_2$ is cut off, and the a-contacts $S_{R2-a1}$ and $S_{R2-a2}$ are opened. Consequently the supply of current to the timer $T_r$ is cut off, and the timer $T_r$ returns to its initial state prior to the start of counting. At the same time, the time limit a-contact $S_{Tr-b}$ is closed, and the system assumes the state indicated in FIG. 1.

In this manner, the pilot lamp PL continues to be lit until, after the driver turns off the engine switch SW, he has rested through at least the rest period set by the timer $T_r$. Accordingly, in the case where the driver has rested only insufficiently, the pilot lamp PL is not extinguished but indicates that further rest should be taken. Thus, the pilot lamp PL has the double function of warning the driver that he has driven over the limit driving time and of warning him that he has not rested through the necessary rest period.

Figure 6:
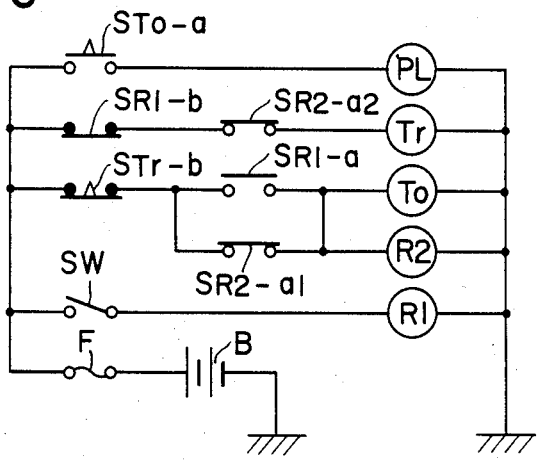

On the other hand, when, with the system in the state of continuous operation indicated in FIG. 2, the engine switch SW is opened prior to the end of the time set by the timer $T_o$ for setting the operation time, that is, when the driver takes a rest before the pilot lamp PL becomes lit as indicated in FIG. 3, the supply of current to the relay $R_1$ is cut off, as indicated in FIG. 6, by the opening of the engine switch SW, and the a-contact $S_{R1-a}$ is opened, while the b-contact $S_{R1-b}$ is closed as shown. Current is thereupon passed by way of the b-contact $S_{R1-b}$ and the a-contact $S_{R2-a2}$ through the timer $T_r$, which thereupon starts to count the rest time period. Since, on the other hand, the supply of current via the time limit b-contact $S_{Tr-b}$ and the a-contact $S_{R2-a1}$ through the timer $T_o$ is continued, the timer $T_o$ continues counting the operation time. That is, in this case, the rest period and the operation time are counted in parallel.

Figure 7:
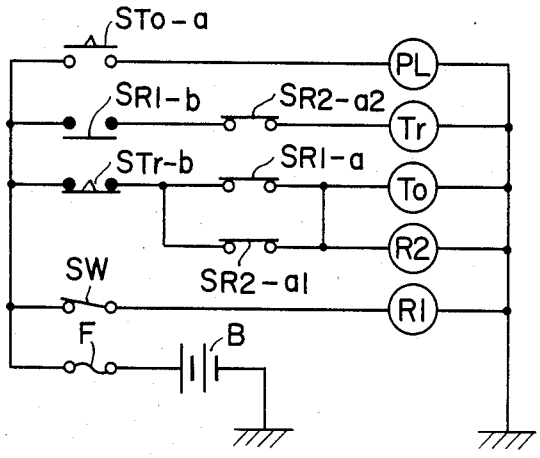

In the case where, from this state, the engine switch SW is closed before the timer $T_r$ has finished counting up, that is, in the case where the engine is restarted before the driver has had ample rest, current is supplied through the relay $R_1$ by the switching on of the engine switch SW, and the a-contact $S_{R1-a}$ and the b-contact $S_{R1-b}$ are closed and opened, respectively, as indicated in FIG. 7. As a consequence, the supply of current to the timer $T_r$ is cut off, and the timer $T_r$ returns to its initial state prior to the start of counting. On the other hand, the timer $T_o$ continues to count, irrespective of whether or not the driver's rest is ample, until the driving limit time is reached. Thus, in the case where the driver has not rested sufficiently, the system does not consider that he has rested but deems that the driving is being continued. Then, when the timer $T_o$ finishes counting the driving limit time including the insufficient rest period, the time limit a-contact $S_{To-a}$ is closed similarly as in the aforedescribed case, and the pilot lamp PL becomes lit to indicate a warning. Thus, driver safety is assured.

Figure 8:
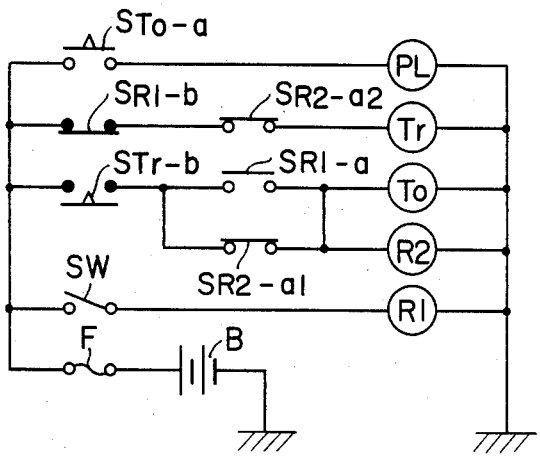

On the other hand, in the case where, from the state indicated in FIG. 6, the driver has had an ample rest, and the period set by the timer $T_r$ ends, the action of this timer $T_r$ first causes the time limit b-contact $S_{Tr-b}$ to be opened as indicated in FIG. 8. Consequently, the supply of current to the timer $T_o$ is cut off, and the timer $T_o$ returns to its initial state prior to the start of its counting. Simultaneously, the supply of current to the relay $R_2$ is also cut off, and the a-contacts $S_{R2-a1}$ and $S_{R2-a2}$ indicated as being in the closed state in FIG. 8 are opened. As a result, the supply of current to the timer $T_r$ is cut off, the timer $T_r$ is returned to its initial state prior to the start of its counting, and at the same time the time limit b-contact $S_{Tr-b}$ is closed. Thus the entire circuit is returned to the state indicated in FIG. 1.

As described above, when the pilot lamp PL becomes lit, the driver can readily see that he has driven more than the driving limit time, and, also during his rest period, the driver can tell that he has not had an ample rest by observing the continued lit state of the pilot lamp. Thus, driving accidents due to causes such as a drop in the driver's attentive power, a dulling of his reflexes, or his becoming sleepy can be prevented. Furthermore, since insufficient rest is counted as driving time without being considered as rest, accidents can be prevented with even greater effectiveness. In addition, because the circuit of the system according to this invention is of simple organization, the system has high reliability yet can be produced to sell at a low price.

While, in the above described example of practice, a pilot lamp PL is used to inform the driver of limit times, another kind of warning means such as a buzzer may be used instead or in addition.

While the system of this invention has been described above with respect to an example thereof applied to a motor vehicle, it will be obvious that the system can be applied with equal effectiveness to other vehicles and machines to be operated over long periods.

What is claimed is:

1. A system for informing a driver of a vehicle of elapsed driving time, said system comprising:

means for detecting starting and stopping of the driving of the vehicle;

a first timer for counting a limit driving time period;

first electric circuit means connecting said detecting means to said first timer, causing the first timer to start operating to count driving time in response to detection of the starting of the driving of the vehicle by said detecting means;

a second timer for counting a rest time period;

second electric circuit means connecting said detecting means to said second timer, causing the second timer to start operating to count rest time in respect to detection of stopping of driving of the vehicle by said detecting means;

warning means for generating and emitting a warning;

third electric circuit means connecting said first timer to said warning means, causing the warning means to generate and emit a warning in respect to completion of the counting of said limit driving time period by said first timer;

fourth electric circuit means connecting said second timer to said warning means, causing the warning means to become inoperative in response to completion of the counting of said rest time period by said second timer; and fifth electric circuit means connecting said detecting means to said first and second timers permitting the counting operation of the first timer to continue and causing the counting operation of the second timer to be nullified in response to detection, by said detecting means, of restarting of the driving of the vehicle before completion of the counting of said rest time period by the second timer.

2. A system according to claim 1, wherein said detecting means is a switch means which is closed when driving of the vehicle starts and opened when driving of the vehicle stops.

3. A system according to claim 2, wherein said switch means is a vehicle engine switch.

4. A system according to claim 2, wherein said first, second, third, fourth and fifth electric circuit means respectively are relay circuit means.

5. A system according to claim 2, wherein said first electric circuit means comprises a first relay in circuit relation with said switch means and having a normally-open relay contact, and means for electrically connecting the relay contact to said first timer in series whereby when the switch means is closed, the first timer is actuated.

6. A system according to claim 2, wherein said second electric circuit means comprises: a first relay in series circuit relation to said switch means and having a normally-open relay contact and a normally-closed relay contact; said normally-open relay contact being connected in series to said first timer, said normally-closed relay contact being connected in series to said second timer; and a second relay connected in series to said normally-open relay contact to thereby the energized when the latter is closed, said second relay having a self-holding relay contact and a normally-open relay contact connected in series to said second timer, whereby when said switch means is opened to stop the vehicle, said normally-closed relay contact of said first relay is closed to cause the second timer to start counting.

7. A system according to claim 2, wherein said third electric circuit means comprises a normally-open relay contact of said first timer, said relay contact being connected in series to said warning means whereby when the counting of said limit driving time period by the first timer has been completed, the relay contact is closed and the warning means is actuated.

8. A system according to claim 7, wherein said fourth electric circuit means comprises a normally-closed relay contact of said second timer, connected in series to said first timer, whereby when the counting of said rest time period by the second timer has been completed, current to the first timer is interrupted and its normally-open relay contact is opened, causing the warning means to become inoperative.

9. A system according to claim 2, wherein said fifth electric circuit means comprises: a first relay inserted in series circuit relation with said switch means and having a normally-open relay contact and a normally-closed relay contact, said normally-open relay contact being connected in series to said first timer, said normally-closed relay contact being connected in series to said second timer, a second relay connected in series to said normally-open relay contact, said second relay having a self-holding relay contact and a normally-open relay contact connected in series to said second timer; and a normally-closed relay contact of said second timer, connected in series to said first timer, whereby when said switch means is closed to restart the driving of the vehicle before completion of the counting of said rest time period, said normally-closed relay contact of the second timer is kept closed to continue the counting operation of the first timer while the normally-closed relay contact of the first relay is opened to interrupt the current to the second timer so as to nullify the counting operation of the latter.

10. A system for informing the driver of a vehicle of driving time, said system comprising:

means for detecting starting and stopping of the driving of the vehicle, said means including an electric switch adapted to be closed or opened when vehicle driving is to be started or stopped, respectively;

a first timer for counting a limit driving time period in response to detection of starting of the driving of the vehicle;

a second timer for counting a rest time period in response to detection of stopping of the driving of the vehicle;

a warning means for generating and emitting a warning;

a first electric relay connected in series to said electric switch;

a second electric relay;

an electric power source, said first timer, second timer, warning device, first relay and second relay being connected in parallel with respect to said electric power source;

a normally-open electric contact of the first relay, connected in series to said first timer;

a normally-closed electric contact of the first relay, connected in series to said second timer;

a first normally-open electric contact of the second relay, connected in series to said second relay;

a second normally-open electric contact of the second relay, connected in series to said second timer;

a normally-open time limit electric contact of said first timer connected in series to said warning means;

a normally-closed time limit electric contact of said second timer, connected in series to said first timer and said normally-open electric contact of the first relay and in series to said second relay and its first normally-open electric contact; and electric circuit means connecting the circuit of said first timer and said normally-open electric contact of the first relay and the circuit of said second relay and said first normally-open electric contact of the second relay in such a manner that the first timer and the first normally-open electric contact of the second relay are connected in series and that the second relay and the normally-open electric contact of the first relay are also connected in series.

11. A system for informing a driver of a vehicle of elapsed driving time, said system comprising:

means for detecting starting and stopping of an engine of the vehicle;

a first timer for counting a limit driving time period;

first electric circuit means connecting said detecting means to said first timer, causing the first timer to start operating to count driving time in response to detection of the starting of the engine of the vehicle by said detecting means;

a second timer for counting a rest time period;

second electric circuit means connecting said detecting means to said second timer, causing the second timer to start operating to count rest time in respect to detection of stopping of the engine of the vehicle by said detecting means;

warning means for generating and emitting a warning; third electric circuit means connecting said first timer to said warning means, causing the warning means to generate and emit a warning in respect to completion of the counting of said limit driving time period by said first timer;

fourth electric circuit means connecting said second timer to said warning means, causing the warning means to become imperative in response to completion of the counting of said rest time period by said second timer, and fifth electric circuit means connecting said detecting means to said first and second timers permitting the counting operation of the first timer to continue and causing the counting operation of the second timer to be nullified in response to detection, by said detecting means, of restarting of the engine of the vheicle before completion of the counting of said rest time period by the second timer.

12. A system according to claim 11, wherein said detecting means is a switch means which is closed when the engine of the vehicle starts and opened when the engine of the vehicle stops.

13. A system according to claim 12, wherein said switch means is a vehicle engine switch.

14. A system according to claim 12, wherein said first, second, third, fourth and fifth electric circuit means respectively are relay circuit means.

15. A system according to claim 12, wherein said first electric circuit means comprises a first relay in circuit relation with said switch means and having a normally-open relay contact, and means for electrically connecting the relay contact to said first timer in series, whereby when the switch means is closed the first timer is actuated.

16. A system according to claim 12, wherein said second electric circuit means comprises:

a first relay in series circuit relation to said switch means and having a normally-open relay contact and normally-closed relay contact, said normally-open relay contact being connected in series to said first timer, said normally-closed relay contact being connected in series to said second timer; and a second relay connected in series to said normally-open relay contact to thereby be energized when the latter is closed, said second relay having a self-holding relay contact and a normally-open relay contact connected in series to said second timer, whereby when said switch means is opened to stop the vehicle, said normally-closed relay contact of said first relay is closed to cause the second timer to start counting.

17. A system according to claim 12, wherein said third electric circuit means comprises a normally-open relay contact of said first timer, said relay contact being connected in series to said warning means whereby when the counting of said limit driving time period by the first timer has been completed, the relay contact is closed and the warning means is actuated.

18. A system according to claim 17, wherein said fourth electric circuit means comprises a normally-closed relay contact of said second timer, connected in series to said first timer, whereby when the counting of said rest time period by the second timer has been completed, current to the first timer is interrupted and its normally-open relay contact is opened, causing the warning means to become inoperative.

19. A system according to claim 12, wherein said fifth electric circuit means comprises:

a first relay inserted in series circuit relation with said switch means and having a normally-open relay contact and normally-closed relay contact, said normally-open relay contact being connected in series to said first timer, said normally-closed relay contact being connected in series to said second timer, a second relay connected in series to said normally-open relay contact, said second relay having a self-holding relay contact and a normally-open relay contact connected in series to said second timer; and a normally-closed relay contact of said second timer, connected in series to said first timer, whereby when said switch means is closed to restart the engine of the vehicle before completion of the counting of said rest time period, said normally-closed relay contact of the second timer is kept closed to continue the counting operation of the first timer while the normally-closed relay contact of the first relay is opened to interrupt the current to the second timer so as to nullify the counting operation of the latter.

20. A system for informing the driver of a vehicle of driving time, said system comprising:

means for detecting starting and stopping of an engine of the vehicle, said means including an electric switch adapted to be closed or opened when the engine is to be started or stopped, respectively;

a first timer for counting a limit driving time period in response to detection of starting of the engine of the vehicle;

a second timer for counting a rest time period in response to detection of stopping of the engine of the vheicle;

a warning means for generating and emitting a warning;

a first electric relay connected in series to said electric switch;

a second electric relay;

an electric power source, said first timer, second timer, warning device, first relay and second relay being connected in parallel with respect to said electric power source;

a normally-open electric contact of the first relay connected in series to said first timer;

a normally-closed electric contact of the first relay connected in series to said second timer;

a first normally-open electric contact of the second relay connected in series to said second relay;

a second normally-open electric contact of the second relay connected in series to said second timer;

a normally-open time limit electric contact of said first timer connected in series to said warning means;

a normally-closed time limit electric contact of said second timer, connected in series to said first timer and said normally-open electic contact of the first relay and in series to said second relay and its first normally-open electric contact; and electric circuit means connecting the circuit of said first timer and said normally-open electric contact of the first relay and the circuit of said second relay and said first normally-open electric contact of the second relay in such a manner that the first timer and the first-normally-open electric conctact of the second relay are connected in series and that the second relay and the normally-open electric contact of the first relay are also connected in series.

* * * * *